US008985191B2

(12) United States Patent
Matsuwaka et al.

(10) Patent No.: US 8,985,191 B2
(45) **Date of Patent: *Mar. 24, 2015**

(54) METHOD FOR MANUFACTURING TITANIUM INGOT

(71) Applicant: Kobe Steel, Ltd., Kobe-shi (JP)

(72) Inventors: Daisuke Matsuwaka, Kobe (JP); Daiki Takahashi, Kobe (JP); Hitoshi Ishida, Kobe (JP); Hiroshi Yokoyama, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/507,869

(22) Filed: Oct. 7, 2014

(65) Prior Publication Data

US 2015/0020646 A1 Jan. 22, 2015

Related U.S. Application Data

(63) Continuation of application No. 14/239,940, filed as application No. PCT/JP2012/070815 on Aug. 16, 2012, now Pat. No. 8,881,792.

(30) Foreign Application Priority Data

Aug. 22, 2011 (JP) ..... 2011-180615

(51) Int. Cl.
*B22D 27/02* (2006.01)
*B22D 11/04* (2006.01)
(Continued)

(52) U.S. Cl.
CPC ..... *C22B 34/1295* (2013.01); *C22B 4/06* (2013.01); *C22B 4/005* (2013.01); *C22B 9/003* (2013.01);
(Continued)

(58) Field of Classification Search
CPC ..... B22D 11/041; B22D 11/116; B22D 27/02
USPC ..... 164/266, 469, 493–495, 506–508, 513
See application file for complete search history.

(56) References Cited

U.S. PATENT DOCUMENTS

RE27,945 E * 3/1974 Hunt et al. ..... 164/512
4,932,635 A 6/1990 Harker
(Continued)

FOREIGN PATENT DOCUMENTS

JP 2000-274951 10/2000
JP 2004-232066 8/2004
(Continued)

OTHER PUBLICATIONS

International Search Report issued Nov. 6, 2012 in PCT/JP12/070815 filed Aug. 16, 2012.
(Continued)

*Primary Examiner* — Kevin E Yoon
(74) *Attorney, Agent, or Firm* — Oblon, McClelland, Maier & Neustadt, L.L.P.

(57) ABSTRACT

The present invention is a method for manufacturing a titanium ingot (30), the method being characterized by comprising: a step of melting a titanium alloy for a predetermined time by cold crucible induction melting (CCIM); a step of supplying molten titanium (6) to a cold hearth (10), and separating high density inclusions (HDIs) (8) by precipitation in the cold hearth (10) while spraying a plasma jet or an electron beam onto the bath surface of the molten titanium (6); and a step of supplying a molten titanium starting material from which the HDIs (8) are separated by precipitation to a mold (20) to obtain the titanium ingot.

8 Claims, 3 Drawing Sheets

(51) Int. Cl.

| | |
|---|---|
| ***B22D 1/00*** | (2006.01) |
| ***C22B 34/12*** | (2006.01) |
| ***C22B 4/06*** | (2006.01) |
| ***C22B 4/00*** | (2006.01) |
| ***C22B 9/00*** | (2006.01) |
| ***B22D 11/116*** | (2006.01) |
| ***B22D 11/041*** | (2006.01) |

(52) U.S. Cl.

CPC ..... *C22B 4/00* (2013.01); *B22D 11/116* (2013.01); *B22D 1/00* (2013.01); *B22D 27/02* (2013.01); *B22D 11/041* (2013.01)

USPC ..... 164/493; 164/459; 164/495; 164/266; 164/506; 164/508

(56) References Cited

U.S. PATENT DOCUMENTS

| | | | | |
|---|---|---|---|---|
| 5,224,534 | A | 7/1993 | Shimizu et al. | |
| 5,819,837 | A | 10/1998 | Hugo et al. | |
| 5,972,282 | A | 10/1999 | Aguirre et al. | |
| 6,144,690 | A | 11/2000 | Kusamichi et al. | |
| 7,757,748 | B2 * | 7/2010 | Shiraki et al. | 164/506 |
| 7,967,057 | B2 | 6/2011 | Kunii et al. | |
| 8,496,046 | B2 | 7/2013 | Nakayama et al. | |
| 8,881,792 | B2 * | 11/2014 | Matsuwaka et al. | 164/493 |
| 2006/0230876 | A1 | 10/2006 | Blum et al. | |
| 2011/0094705 | A1 | 4/2011 | Kelly et al. | |

FOREIGN PATENT DOCUMENTS

| | | |
|---|---|---|
| JP | 2004-276039 | 10/2004 |
| JP | 2005-508758 | 4/2005 |
| JP | 2009-161855 | 7/2009 |

OTHER PUBLICATIONS

Written Opinion of the International Searching Authority issued Nov. 6, 2012 in PCT/JP12/070815 filed Aug. 16, 2012.

* cited by examiner

METHOD FOR MANUFACTURING TITANIUM INGOT

This application is a continuation of U.S. application Ser. No. 14/239,940 filed Feb. 20, 2014, which is a National Stage of PCT/JP2012/070815 filed Aug. 16, 2012, both of which are incorporated herein by reference. This application also claims the benefit of JP 2011-180615 filed Aug. 22, 2011.

TECHNICAL FIELD

The present invention relates to a method for manufacturing a titanium ingot high in quality and reliability, which is used as, for example, a material of an aircraft.

BACKGROUND ART

In recent years, titanium alloy (the alloy being allowable to be pure titanium; in the present specification, "titanium alloy" is a metal including, as an example thereof, pure titanium hereinafter) has come to be used in the field of aircrafts and various other fields. Under such a situation, titanium alloy manufacturers have paid attention to a technique of making use of, for example, an inexpensive titanium material or titanium scrap material large in unevenness of the shapes of pieces thereof, and unevenness of the composition thereof to manufacture titanium ingots low in costs and high in quality and reliability.

However, in a titanium ingot produced by melting, as titanium alloy, an inexpensive titanium material or titanium scrap material as described above, which is large in unevenness of the piece shape/composition thereof, the following remain: low density inclusions (hereinafter referred to as "LDIs") having a specific gravity equivalent to or lower than that of titanium, specifically, a specific gravity of 5 g/cm$^3$ or less; and high density inclusions (hereinafter referred to as "HDIs") having a specific gravity more than that of titanium (specific gravity: more than 5 g/cm$^3$). Thus, the inclusions produce a bad effect onto mechanical properties of the alloy. It is generally said that the proportion of the number of the LDIs as inclusions remaining in the titanium ingot to that of the LDIs as inclusions remaining in the titanium alloy as the raw material is from 5 to 6%. In the case of using titanium alloy, particularly, as a material for aircrafts, it is desired to make this proportion smaller. As a technique for solving such a problem, methods described below have been suggested.

Disclosed is, for example, a technique of an electron beam melting method using a hearth, in which an electron beam is scanned to a direction reverse to the direction along which titanium alloy melted in the hearth (hereinafter referred to as "melted titanium") flows toward a mold, and further the average temperature of the melted titanium in the vicinity of a melted-titanium-outlet in the hearth is set to the melting point of LDIs therein or higher (see PTL 1). The use of this technique makes it possible to manufacture a titanium ingot in which the proportion of the LDIs is decreased from 5% to less than 1% by melting a raw material, i.e., a titanium sponge containing the LDIs, which have a grain diameter of 0.2 to 1.0 mm, together with HDIs, separating the HDIs by precipitation from the melted titanium, and further melting the LDIs in the melted titanium.

Disclosed is also a technique of causing the flow of melted titanium inside a hearth to rise along the vertical direction and subsequently descend, thereby making the residence period of the flow long to melt LDIs therein and further trap HDIs therein onto the bottom of the hearth (see PTL 2). The use of this technique makes it possible to manufacture a titanium ingot in which the proportion of the LDIs is decreased from 6% to less than 1% by melting a raw material, i.e., a titanium sponge containing the LDIs, which have a grain diameter of 1.0 to 3.0 mm, together with the HDIs, separating the HDIs by precipitation from the melted titanium, and further melting the LDIs in the melted titanium.

CITATION LIST

Patent Literatures

[PTL 1] JP 2004-232066 A
[PTL 2] JP 2009-161855 A

SUMMARY OF INVENTION

Technical Problem

However, the techniques disclosed in the Patent literatures 1 and 2 have the following problems:

When LDIs have a grain diameter of about 0.2 to 1.0 mm, the technique described in Patent Literature 1 makes it possible to melt the LDIs in melted titanium sufficiently. However, when the grain diameter of the LDIs becomes as large as a size up to about 10 to 15 mm, the LDIs come to pass through low-temperature spots in the melted titanium so that the LDIs become unable to be sufficiently melted. Thus, it is feared that unmelted fractions of the LDIs, together with the melted titanium, flow into a mold.

When LDIs have a grain diameter of about 1.0 to 3.0 mm, the technique described in Patent Literature 2 makes it possible to keep certainly a residence period for melting the LDIs even when the flow of the melted titanium is passed so as to rise along the vertical direction and subsequently descend. However, when the grain diameter of the LDIs becomes as large as a size up to about 10 to 15 mm, a passage as described above cannot certainly keep the residence period for melting the LDIs. Thus, it is feared that the LDIs in the melted titanium cannot be completely melted.

An object of the present invention is to provide a titanium ingot manufacturing method that is capable of removing HDIs from titanium alloy and further decreasing the proportion of LDIs having a grain diameter up to about 10 to 15 mm to about 1% or less, and capable of yielding a titanium ingot high in quality and reliability at low costs.

Solution to Problem

In order to attain this object, the invention according to claim 1 is a method for manufacturing a titanium alloy ingot (the titanium alloy being allowable to be pure titanium), comprising the steps of:

(a) melting a titanium material or titanium scrap material (hereinafter referred to as "titanium material") by a cold crucible induction melting (hereinafter referred to as "CCIM") in such a manner that the following expression (1) can be satisfied:

$$y \geq 700 \times A^{-1.2} \quad (1)$$

wherein A=P/(V/S) wherein y: the period [min] for the melting,

A: a thermal balance parameter,

P: the applied electric power [kW] in the CCIM,

V: the volume [m$^3$] of the melted titanium, and

S: the surface area [m$^2$] of the melted titanium, (b) supplying, after the step (a), the resultant titanium material, which has been melted (hereinafter referred to as the "melted titanium material"), to a cold hearth, and separating an inclusion having a large specific gravity which is more than 5 g/cm$^3$ by precipitation inside the cold hearth while a plasma jet is blown onto or an electron beam is radiated onto a surface of the melt of the melted titanium material, thereby yielding a titanium alloy, and (c) supplying, into a mold, the resultant titanium material, in which the inclusion, the specific gravity of which is large, has been separated by precipitation, thereby yielding the titanium ingot.

Advantageous Effects of Invention

As described above, in the manufacture of a titanium ingot, a titanium alloy is melted by a CCIM in such a manner that the following expression (1) can be satisfied, thereby melting an LDI in the melted titanium; in the next step, the melted titanium, in which the LDI has been melted, is supplied into a cold hearth, and an HDI therein is separated by precipitation in the cold hearth while a plasma jet is blown onto or an electron beam is radiated onto a surface of the melt of the melted titanium material; and next the melted titanium material, in which the HDI has been separated by precipitation, is supplied to a mold:

$$y \geq 700 \times A^{-1.2} \quad (1)$$

wherein A=P/(V/S) wherein y: the period [min] for the melting,

A: a thermal balance parameter,

P: the applied electric power [kW] in the CCIM,

V: the volume [ms] of the melted titanium, and

S: the surface area [m$^2$] of the melted titanium.

Even in the case of melting, in particular, a titanium alloy containing LDIs having a grain diameter up to about 10 to 15 mm (for example, an inexpensive titanium material or titanium scrap material large in unevenness of the piece shape/composition thereof), this method makes it possible to melt the LDIs in the resultant melted titanium. It is therefore possible to manufacture a titanium ingot high in quality and reliability at low costs, in which HDIs have been removed from the titanium alloy and the proportion of the LDIs, the grain diameter of which is up to about 10 to 15 mm, has been decreased to about 1% or less.

DESCRIPTION OF EMBODIMENTS

Hereinafter, the present invention will be described in detail by way of embodiments thereof.

The inventors have made eager researches about the following: even when a titanium alloy containing LDIs having a grain diameter up to about 10 to 15 mm is melted, what should be done in order to remove HDIs from the titanium alloy and further decrease the proportion of the LDIs to about 1% or less.

First, in a laboratory experiment for producing titanium ingots, a CCIM-used step as described above has been used, and a CCIM has been performed at a high-frequency power supply output of 350 kW (inside diameter of a water-cooled copper crucible used: 200 mm) to find out that as far as a titanium alloy is melted over about 60 minutes, five LDIs having a grain diameter of 10 mm and added to the melted titanium can be completely melted. This finding has been a clue to the present invention (see Example 1, which will be described later).

In another laboratory experiment for producing titanium ingots, a CCIM-used step as described above has been used, and in the CCIM (in which a water-cooled copper crucible having the same dimension as described above has been used) the high-frequency power supply output (the applied electric power P in the CCIM, and hereinafter the output may be referred to as the "applied electric power P") has been used as a parameter to find out the shortest melting period (y) necessary for melting each of various LDI species, which have various grain diameters up to about to 15 mm, completely into melted titanium (see Example 2, which will be described later, and FIG. 2).

Figure 3:
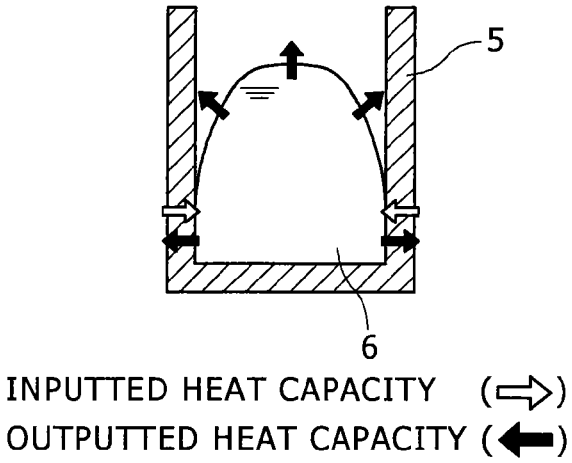
FIG. 3 is a schematic sectional view that schematically illustrates a relationship between the heat capacity inputted to the melted titanium in the step using the CCIM illustrated in FIG. 1(*a*) and the heat capacity outputted from the melted titanium.
Figure 4:
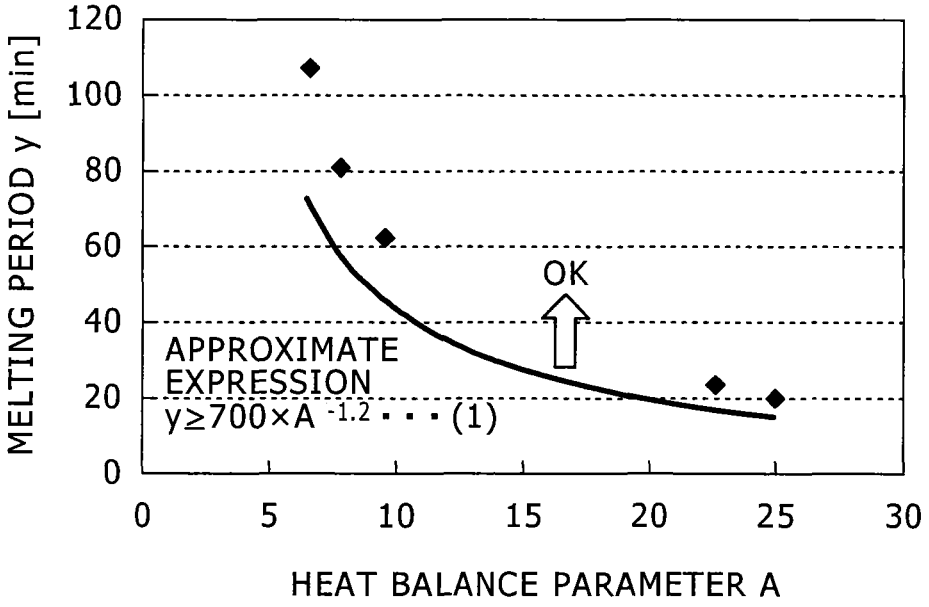
FIG. 4 is a characteristic chart showing, in a method of the present invention for manufacturing a titanium ingot, a relationship between the "heat balance parameter (A)" and the "shortest melting period (y) necessary for melting LDIs therein completely".

In light of the above-mentioned results, in a CCIM-used step illustrated in FIG. 1(*a*), about which a detailed description will be made later, titanium alloys containing LDIs 7 having a grain diameter up to about 10 to mm have been supplied to various water-cooled copper crucibles 5, which have various volumes (from a volume corresponding to an inside diameter of about 150 mm for laboratory experiments to one corresponding to an inside diameter of 1000 mm for mass-production facilities). In order to examine, in each of these cases, the relationship between the heat capacity inputted (electric power P applied) to a melted titanium 6 and the heat capacity outputted from the melted titanium (the volume V and the surface area S of the melted titanium) 6 (see FIG. 3), a heat balance parameter (A) as described below has been newly introduced. By the introduction of this heat balance parameter (A), the inventors have found out, through trials and errors, an approximate expression (1) described below that shows a relationship as shown in FIG. 4 between the "heat balance parameter (A)" and the "the shortest melting period (y) necessary for melting the LDIs 7 completely in the melted titanium 6", and that could not have been guessed even by those skilled in the art. This finding is a central point of the present invention. Specifically, this expression shows that it is advisable to melt, in a CCIM-used step, a titanium alloy while the following period is spent for each value of the heat balance parameter (A): a period equal to or more than the melting period (y) according to the approximate expression (1) shown in FIG. 4.

$$y \geq 700 \times A^{-1.2} \quad (1)$$

wherein A=P/(V/S) wherein y: the period [min] for the melting,

A: a thermal balance parameter,

P: the applied electric power [kW] in the CCIM,

V: the volume [m$^3$] of the melted titanium 6, and

S: the surface area [m$^2$] of the melted titanium 6.

Moreover, in a "step of supplying the melted titanium 6 in which the LDIs 7 have been melted to a cold hearth 10, and separating HDIs 8 by precipitation inside the cold hearth 10 while a plasma jet is blown onto or an electron beam is radiated onto a surface of the melt of the melted titanium 6", this step being illustrated in FIG. 1(*b*), about which a detailed description will be made later, it is presumed that the terminal sedimenting speed $u_t$ [see an expression (2) described below] of the HDIs 8 in the melted titanium 6 is about 0.8 m/s. It is therefore advisable to blow the plasma jet onto the surface of the melt of the melted titanium 6 or radiate the electron beam onto the surface in such a manner that, for example, an expression (3) described below can be satisfied. Usually, when a cold hearth is used to separate HDIs in a melted titanium by use of a plasma jet or an electron beam, the separation is attained in such a manner that the condition of the expression (3) described below can be satisfied.

[Mathematical Expression 1]

$$u_t = \left(\frac{3d\Delta\rho g}{\rho}\right)^{1/2} \tag{2}$$

wherein $u_t$: the terminal sedimenting speed (m/s), d: the diameter (m) of the HDIs 8, Δρ: the density difference (g/cm$^3$) between the HDIs 8 and the melted titanium 6, g: the gravitational acceleration (m/s$^2$), and ρ: the density (g/cm$^3$) of the melted titanium 6.

$$H/u_t < V/v \tag{3}$$

wherein $H/u_t$=the period (s) up to a time when the HDIs 8 reach the solidified scars on the bottom of the cold hearth 10, and V/v=the residence period (s) inside the cold hearth 10, wherein H: the height (m) of the cold hearth 10, $u_t$: the terminal sedimenting speed (m/s), V: the volume (m$^3$) of the cold hearth 10, and v: casting speed (m$^3$/s).

As described above, in the method of the present invention for manufacturing a titanium ingot, a titanium alloy is melted by a CCIM in such a manner that the expression (1) can be satisfied, thereby melting LDIs in the melted titanium; and in the next step, the melted titanium, in which the LDI have been melted, is supplied into a cold hearth, and HDIs therein are separated by precipitation inside the cold hearth while a plasma jet is blown onto or an electron beam is radiated onto a surface of the melt of the melted titanium. In this way, the HDIs can be removed from the titanium alloy, and further the proportion of LDIs having a grain diameter up to about 10 to 15 mm, out of the entire LDIs, can also be decreased to about 1% or less.

It is more preferred to set the melted period (y) to satisfy the following expression (4):

$$y \geq 900 \times A^{-1.2} \tag{4}$$

In this case, the melting of the LDIs further advances.

EXAMPLES

Hereinafter, a description will be made about an example of the method of the invention for manufacturing a titanium ingot, referring to some of the drawings.

Figure 1:
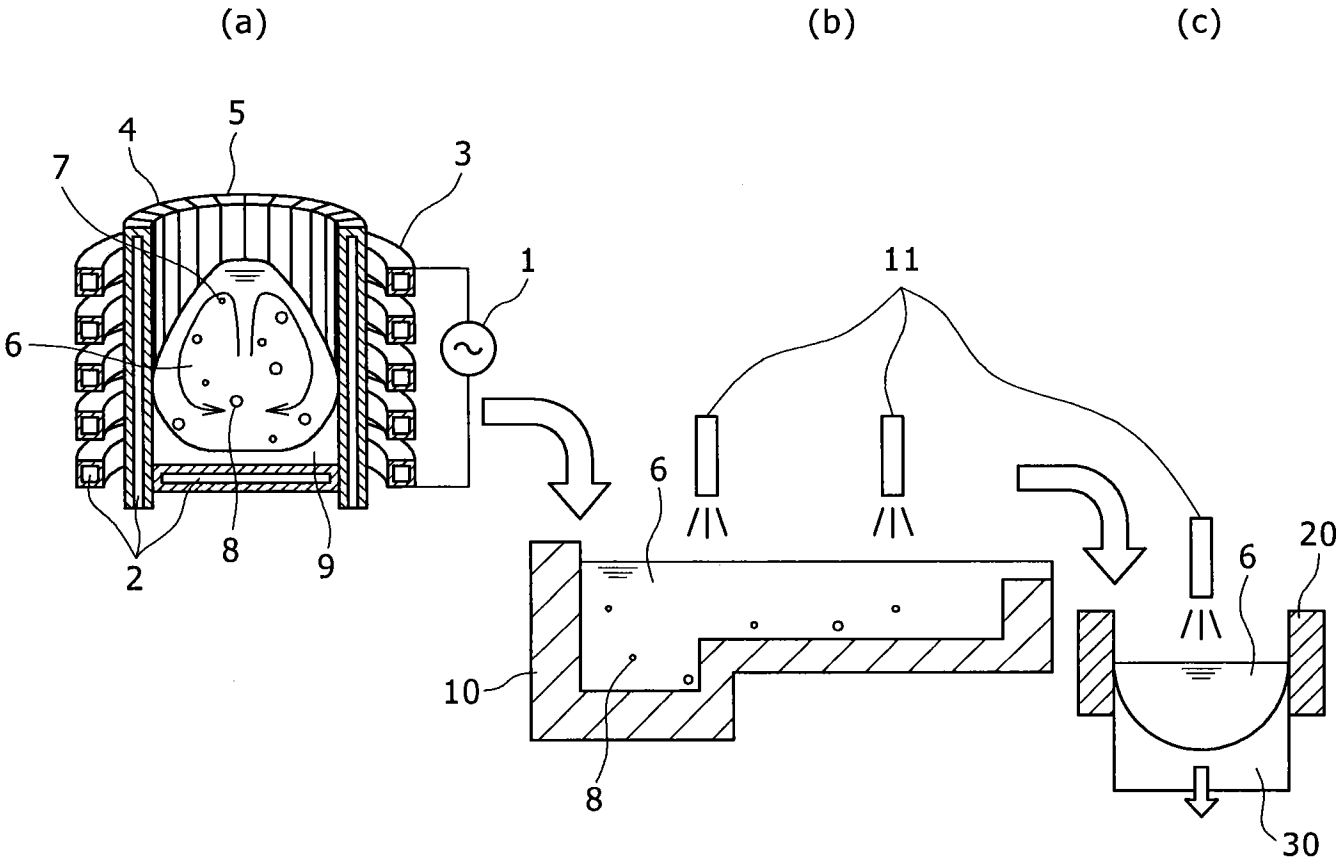
FIG. 1 are schematic views referred to for describing, along time sequence, a process of an example of the method of the present invention for manufacturing a titanium ingot.

FIG. 1 are schematic views referred to for describing, along time sequence, a process of an example of the method of the present invention for manufacturing a titanium ingot. FIG. 1(*a*) is a view illustrating a step of melting a titanium scrap material as a titanium alloy supplied to a water-cooled crucible 5 by a CCIM, and then melting LDIs 7 in this melted titanium alloy (melted titanium 6) completely; FIG. 1(*b*) is a view illustrating a step of supplying, to a cold hearth 10, the melted titanium 6 in which the LDIs 7 have been completely melted, and then separating HDIs 8 by precipitation inside the cold hearth 10 while a plasma jet is blown onto a surface of the melt of the melted titanium 6; and FIG. 1(*c*) is a view illustrating a step of supplying the melted titanium 6 in which the HDIs 8 have been separated by precipitation in the step illustrated in FIG. 1(*b*) to a mold 20 to yield a titanium ingot 30.

In the CCIM illustrated in FIG. 1(*a*), the water-cooled crucible 5 (inside diameter: 200 mm), which is divided by slits 4, is set inside a high-frequency coil 3 connected to a high-frequency power supply 1 and further cooled through a cooling water 2. A high-frequency magnetic field generated by the high-frequency coil 3 is passed through the slits 4 to melt the titanium scrap material as a titanium alloy, which contains the LDIs 7 and the HDIs 8. In this way, the melted titanium 6 is obtained. By using this CCIM to melt the titanium scrap material to satisfy the expression (1), the melted titanium 6 is intensely stirred so that the temperature of the melt is evenly kept at a high temperature. For this reason, at least the LDIs 7 in the melted titanium 6 are completely melted, and further the HDIs 8 are also melted into the melted titanium 6 (however, in accordance with the grain diameter of the HDIs 8, some of the HDIs 8 are trapped onto solidified scars 9 present on the bottom of the water-cooled crucible 5).

In FIG. 1(*b*), the melted titanium 6 in which the LDIs 7 have been completely melted in the step illustrated in FIG. 1(*a*) is supplied to the cold hearth 10. While a plasma jet is blown from a plasma torch 11 onto the melt surface of the melted titanium 6, fractions of the HDIs 8 remaining partially in the melted titanium 6 are also separated by precipitation onto the bottom of the cold hearth 10. Through this step, the HDIs 8 can be removed from the melted titanium 6 and further the proportion of LDIs 7 having a diameter up to about 10 to 15 mm, out of the entire LDIs, can also be decreased to 1% or less, in particular, even when the melted titanium 6 is drawn out from the water-cooled crucible 5 to be discharged.

In FIG. 1(*c*), the melted titanium 6 in which the HDIs 8 have been separated by precipitation in the step illustrated in FIG. 1(*b*) is supplied to the mold 20. While a plasma jet is blown from the plasma torch 11 onto the melt surface of the melted titanium 6, the melted titanium is drawn downward to yield the titanium ingot 30. This process makes it possible to manufacture a titanium ingot high in quality and reliability at low costs, in which the HDIs 8 are removed from the titanium scrap material as the starting material (titanium alloy) and further the proportion of the LDIs 7 having a diameter up to about 10 to 15 mm is also decreased to 1% or less. Furthermore, the titanium ingot yielded in the step illustrated in FIG. 1(*c*) is used as an electrode to be subjected to VAR melting. After the VAR melting, a titanium ingot as a final product is yielded (not illustrated).

Example 1

Into the above-mentioned water-cooled crucible 5, the inside diameter of which was 200 mm, were supplied 20 kg of Ti-6Al-4V alloy, and five TiN grains having a grain diameter of 10 mm, which were regarded as the LDIs 7. A melting experiment was then made according to a CCIM.

<Melting Conditions>

High-frequency power supply 1 output (applied electric power P): 350 kW

Melted titanium 6 temperature: 1,700° C.

Melted titanium 6 surface speed: 0.3 m/s

Melting period (y): 65 min

After the above-mentioned melting experiment was made, the ingot was examined. As a result, the LDIs 7 were not detected in the ingot. This demonstrated that the adoption of such a CCIM makes it possible to melt LDIs 7 having a large grain diameter such as a grain diameter of 10 mm completely.

Example 2

In the same way as in Example 1, into the water-cooled crucible 5, the inside diameter of which was 200 mm, were appropriately supplied 20 kg of Ti-6Al-4V alloy, and each of various TiN grain species, which had various grain diameters up to 15 mm and were each regarded as the LDIs 7. A melting experiment according to a CCIM was then made thereabout. The applied electric power P was used as a parameter. In this parameter-used case, about each of the grain diameters of the LDIs 7, the following was examined: the melting period (y) for which the LDIs 7 were able to be completely melted.

Figure 2:
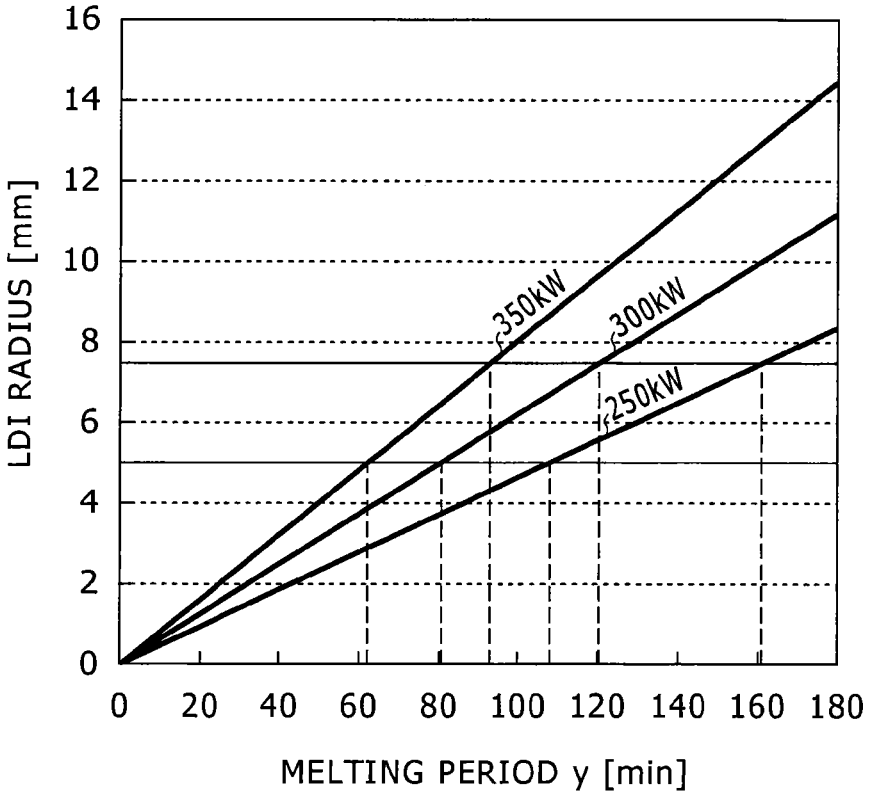
FIG. 2 is a characteristic chart showing a relationship obtained when the applied electric power P in a CCIM in an example of the method of the present invention for manufacturing a titanium ingot is used as a parameter, this relationship being between the "LDIs (LDI radii) of various grain diameters" and the respective "melting periods (y)" of the LDIs.

As shown in FIG. 2, it was made clear from the results of the present melting experiment that when applied electric powers P of three levels of 250 kW, 300 kW and 350 kW were supplied, respectively, for example, the LDIs 7 the diameter of which was 10 mm (LDI radius: 5 mm) were able to be completely melted as far as, as the melting period (y), times of 108 min, 81 min and 62 min were spent, respectively, for the melting. It was also made clear that when applied electric powers P of three levels of 250 kW, 300 kW and 350 kW were supplied, respectively, for example, the LDIs 7 the diameter of which was 15 mm (LDI radius: 7.5 mm) were able to be completely melted as far as, as the melting period (y), times of 161 min, 121 min and 92 min were spent, respectively, for the melting. In other words, this suggests that about titanium alloys which each have a predetermined weight and which contain, respectively, LDIs 7 having various grain diameters up to about 10 to 15 mm, the LDIs 7 can be completely melted as far as an appropriate melting period (y) is spent for each of the titanium alloys in accordance with the electric power P applied thereto.

The present invention has been described in detail or described with reference to the specific embodiments. However, it is clear for those skilled in the art that various changes or modifications can be added thereto as far as the changed or modified embodiments do not each depart from the spirit and scope of the invention.

The present application is based on Japanese Patent Application (No. 2011-180615) filed on Aug. 22, 2011. The contents thereof are incorporated hereinto by reference.

INDUSTRIAL APPLICABILITY

The present invention is useful for the manufacture of a titanium ingot used as a material of aircrafts or others.

REFERENCE SIGNS LIST

1: High-frequency power supply
2: Cooling water
3: High-frequency coil
4: Slits
5: Water-cooled copper crucible
6: Melted titanium
7: LDIs
8: HDIs
9: Solidified scars
10: Cold hearth
11: Plasma torch or electron beam radiating torch
20: Mold
30: Titanium ingot

The invention claimed is:

1. A method for manufacturing a titanium alloy ingot (the titanium alloy being allowable to be pure titanium), comprising:

(a) melting a titanium material or titanium scrap material (hereinafter referred to as "titanium material") by a cold crucible induction melting (hereinafter referred to as "CCIM") in such a manner that the following expression (1) can be satisfied:

$$y \geq 700 \times A^{-1.2} \quad (1)$$

wherein A=P/(V/S) wherein
y: the period [min] for the melting,
A: a thermal balance parameter,
P: the applied electric power [kW] in the CCIM,
V: the volume [$m^3$] of the melted titanium, and
S: the surface area [$m^2$] of the melted titanium, (b) supplying, after (a), the resultant titanium material, which has been melted (hereinafter referred to as the "melted titanium material"), to a cold hearth, and separating an inclusion having a large specific gravity which is more than 5 g/$cm^3$ (hereinafter referred to as "HDIs") by precipitation inside the cold hearth while a plasma jet is blown onto or an electron beam is radiated onto a surface of the melted titanium material, thereby yielding a titanium alloy, and (c) supplying, into a mold, the titanium alloy, in which the inclusion, the specific gravity of which is large, has been separated by precipitation, thereby yielding the titanium ingot, wherein inclusions having a specific gravity of 5 g/$cm^3$ or less and a grain diameter of up to about 15 mm present in said titanium material are decreased in amount such that the proportion is about 1% or less of the starting amount thereof as a result of carrying out (a).

2. The method according to claim 1, wherein melted period (y) satisfies the following expression (4):

$$y \geq 900 \times A^{-1.2} \quad (4).$$

3. The method according to claim 1, wherein in (b), $u_t$ is about 0.8 m/s according to the following expression (2):

$$u_t = \left(\frac{3d\Delta\rho g}{\rho}\right)^{1/2} \quad (2)$$

wherein
$u_t$: the terminal sedimenting speed (m/s),
d: the diameter (m) of the HDIs,
Δρ: the density difference (g/$cm^3$) between the HDIs and the melted titanium,
g: the gravitational acceleration (m/$s^2$), and
ρ: the density (g/$cm^3$) of the melted titanium.

4. The method according to claim 1, wherein in (b), said separating is attained in such a manner that the condition of the following expression (3) can be satisfied:

$$H/u_t < V/v \quad (3)$$

wherein
$H/u_t$=the period (s) up to a time when the HDIs reach solidified scars on the bottom of the cold hearth, and
V/v=the residence period (s) inside the cold hearth,
wherein
H: the height (m) of the cold hearth, $u_t$: the terminal sedimenting speed (m/s), V: the volume ($m^3$) of the cold hearth, and v: casting speed ($m^3$/s).

5. A method for producing a melted titanium material comprising:

melting a titanium material or titanium scrap material (hereinafter referred to as "titanium material") by a cold crucible induction melting (hereinafter referred to as "CCIM") in such a manner that the following expression (1) can be satisfied:

$$y \geq 700 \times A^{-1.2} \quad (1)$$

wherein A=P/(V/S) wherein y: the period [min] for the melting,

A: a thermal balance parameter,

P: the applied electric power [kW] in the CCIM,

V: the volume [$m^3$] of the melted titanium, and

S: the surface area [$m^2$] of the melted titanium.

6. The method according to claim 5, wherein melted period (y) satisfies the following expression (4):

$$y \geq 900 \times A^{-1.2} \quad (4).$$

7. The method according to claim 6, wherein inclusions having a specific gravity of 5 g/$cm^3$ or less and a grain diameter of up to about 15 mm present in said titanium material are decreased in amount such that the proportion is about 1% or less of the starting amount thereof as a result of said melting.

8. The method according to claim 5, wherein inclusions having a specific gravity of 5 g/$cm^3$ or less and a grain diameter of up to about 15 mm present in said titanium material are decreased in amount such that the proportion is about 1% or less of the starting amount thereof as a result of said melting.

* * * * *